US009146490B2

(12) United States Patent
Watanabe

(10) Patent No.: US 9,146,490 B2
(45) Date of Patent: Sep. 29, 2015

(54) IMAGE FORMING APPARATUS HAVING DUEL COLOR IMAGE FORMING CONTROL MODES

(75) Inventor: Yasunari Watanabe, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 623 days.

(21) Appl. No.: 13/454,294

(22) Filed: Apr. 24, 2012

(65) Prior Publication Data

US 2012/0275804 A1 Nov. 1, 2012

(30) Foreign Application Priority Data

Apr. 27, 2011 (JP) ..... 2011-099317
Apr. 10, 2012 (JP) ..... 2012-089377

(51) Int. Cl.
*G03G 15/01* (2006.01)
*G03G 15/16* (2006.01)

(52) U.S. Cl.
CPC ..... *G03G 15/0136* (2013.01); *G03G 15/0189* (2013.01); *G03G 15/161* (2013.01); *G03G 15/168* (2013.01); *G03G 15/1675* (2013.01)

(58) Field of Classification Search
CPC ..... G03G 15/0136; G03G 15/1675
See application file for complete search history.

(56) References Cited

U.S. PATENT DOCUMENTS 6,473,574 B1 10/2002 Usui et al.
7,239,827 B2 * 7/2007 Furukawa ..... 399/149
2006/0088343 A1 * 4/2006 Watanabe et al. ..... 399/297
2007/0047992 A1 * 3/2007 Kubo ..... 399/71
2009/0232530 A1 * 9/2009 Saito et al. ..... 399/50
2011/0158666 A1 * 6/2011 Furukawa ..... 399/46
2012/0008970 A1 * 1/2012 Takenaka ..... 399/66
2014/0314431 A1 * 10/2014 Morihara et al. ..... 399/46
2014/0369706 A1 * 12/2014 Shimizu ..... 399/66

FOREIGN PATENT DOCUMENTS

JP 2001-147572 A 5/2001
JP 2004-21134 A 1/2004
JP 2008-309904 A 12/2008

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus includes a first toner image bearing member, a second drum, an intermediary transfer member, or belt, a secondary transfer member, a toner charging member, and a controller for controlling an operation in a single-color image forming mode and an operation in a multi-color image forming mode. The controller effects, in a post-processing operation after the operation in the single-color image forming mode in which the toner image is formed on the first drum is ended, control such that a separation state between the drum and belt is switched to a contact state between the image bearing member and belt and then the toner deposited on the toner charging member is collected onto the second drum via the belt and then is collected by a cleaning device provided for the second drum.

4 Claims, 9 Drawing Sheets

IMAGE FORMING APPARATUS HAVING DUEL COLOR IMAGE FORMING CONTROL MODES

FIELD OF THE INVENTION AND RELATED ART

The present invention relates to an image forming apparatus of an in-line (tandem) type in which a multi-color image can be formed on a recording material.

An electrophotographic color image forming apparatus of the in-line type, such as a color copying machine or a color printer will be described as an example. This apparatus forms toner images different in color on a plurality of juxtaposed photosensitive members (image bearing members) and then successively transfers the toner images superposedly to record a synthetic color image, thus facilitating speed-up of image formation.

The image forming apparatus of the in-line type is classified into an intermediary transfer type (indirect transfer type) and a direct transfer type depending on a difference in transfer type. In the intermediary transfer type, toner images formed on a plurality of juxtaposed photosensitive members are successively transferred superposedly onto the intermediary transfer member by a primary transfer device to obtain synthetic color images. Then, the color images are collectively secondary-transferred onto the recording material by a secondary transfer device. On the other hand, in the direct transfer type, the toner images formed on the plurality of juxtaposed photosensitive members are successively transferred superposedly onto the recording material carried and conveyed by a recording material carrying member by a transfer device to form a synthetic color image.

As the intermediary transfer member or the recording material carrying member, an endless belt which is circulation-moved and a cylindrical drum which is rotated are used. On the intermediary transfer member, the toner remains in some amount after a secondary transfer step. Further, also on the recording material carrying member, the toner is deposited in some amount at a portion corresponding to a sheet interval, or the like.

As a method of collecting the residual toner remaining on the intermediary transfer member after the secondary transfer step, a method in which the residual toner is charged to an opposite polarity to a normal charge polarity of the toner by a charging means (cleaning roller) and then is subjected to reverse transfer onto the photosensitive member in a primary transfer step to be collected onto the photosensitive member has been known.

In order to remove the residual toner from the intermediary transfer member, Japanese Laid-Open Patent Application (JP-A) 2004-021134 proposes the following image forming apparatus. The image forming apparatus includes a plurality of process cartridges each including a photosensitive drum for bearing the toner image, a cleaning device for removing the residual toner and a residual toner container for collecting the residual toner. Further, the process cartridge for a first color of which the toner image is first transferred onto the intermediary transfer member and the process cartridge for black which is high in operation frequency are made higher in volume of the residual toner container than those of other residual toner containers.

By the above constitution, an exchange frequency of the cartridges for colors which are low in use frequency is reduced to lower a frequency of unnecessary cartridge exchange, so that the unnecessary cartridge exchange is suppressed even during the use of a single-color cartridge and thus a cost can be reduced.

U.S. Pat. No. 6,473,574 proposes a method in which a photosensitive member to be used for collecting a residual toner from a transfer belt is selected by a CPU on the basis of image data. Specifically, in the case where an integrated value of an amount of consumed toner obtained from the image data exceeds a certain amount, the residual toner on the transfer belt is not collected by an associated process cartridge. By this constitution, the residual toner is prevented from being collected locally in the residual toner container in a certain process cartridge, so that a plurality of residual toner containers can be effectively utilized.

Incidentally, in many cases, the image forming apparatus such as the copying machine or the laser beam printer is generally operated in operations in some difference printing modes or sequences. These printing modes or sequences are provided for realizing printing operations for different purposes or provided for effecting totally efficient printing and generally include a normal mode and a low-speed mode. Incidentally, it is assumed that the operation in the normal mode is used for effecting standard printing and the operation in the low-speed mode is designated when the image is printed on an OHP sheet or thick paper for which a different transfer condition or a different fixing condition is employed.

Further, the image forming apparatus of the in-line type is operable in a full-color mode for carrying out normal full-color image formation and a monochromatic mode for printing an image of a specific color (principally black) by using the process cartridge for a predetermined (single) color. Here, during the operation in the monochromatic mode, in order to prevent deterioration of other process cartridges, these process cartridges are separated (spaced) from the intermediary transfer member and are stopped.

JP-A 2001-147572 proposes a method in which when the toner deposited on a transfer material carrying member or the intermediary transfer member is electrostatically collected by the image bearing members, the image forming mode is once changed in the full-color mode and thus all the image bearing members are contacted to the transfer material carrying member or the intermediary transfer member. As a result, the surface of the transfer material carrying member or the intermediary transfer member is cleaned.

A cleaning method of the intermediary transfer member during the image formation will be described. In the cleaning operation in the full-color mode, the residual toner on the intermediary transfer member is all collected by the process cartridge in a first station located at an upstreammost position where the toner image is first transferred onto the intermediary transfer member. This is because the residual toner may preferably be collected at the first station since a method in which the residual toner is collected by reverse transfer simultaneously with the primary transfer is employed.

The toner on the intermediary transfer member before the secondary transfer step is generally charged to the negative polarity which is a normal charge polarity of the toner. However, a positive bias voltage is applied in the secondary transfer step and therefore the toner particles are influenced by the positive bias voltage, so that positive and negative toner particles are present on the intermediary transfer member after the secondary transfer step.

Further, the positive bias voltage is applied to the cleaning roller, so that the negative residual toner is liable to be deposited on the cleaning roller. For this reason, as predetermined timing during non-image formation, at the time when a single print job (a series of image forming operations on a single or a plurality of toner image receiving materials (recording materials) based on an image formation start command (signal)) is ended, an operation for moving the residual toner, deposited on the cleaning roller, onto the intermediary transfer member is performed.

The negative residual toner moved on the intermediary transfer member can be reversely transferred and collected onto the photosensitive drum by applying a negative bias voltage (i.e., the same polarity as the normal charge polarity of the toner), opposite to that during the image formation, to the primary transfer roller.

JP-A 2008-309904 proposes a method in which the toner moved from the cleaning roller is passed through the first station and is collected substantially uniformly at second, third and fourth stations.

During the operation in the monochromatic mode, in order to prevent deterioration of process cartridges for other colors, these process cartridges are separated from the intermediary transfer member and are stopped. Further, similarly as in the operation in the full-color mode, the negative residual toner is liable to be deposited on the cleaning roller provided on the intermediary transfer member. For this reason, at the time when the single print job is ended, the operation for moving the residual toner, detected on the cleaning roller, onto the intermediary transfer member is similarly performed. By this cleaning operation in the monochromatic mode, the residual toner is collected, in the process cartridge (black cartridge) itself used in the operation in the monochromatic mode, by the reverse transfer simultaneously with the primary transfer.

In recent years, a penetration rate of the color image forming apparatus is increased, so that printing of a monochromatic color (principally only black) is effected by the color image forming apparatus in many cases. In the operation in the full-color mode, the residual toner was collected by the respective color process cartridges in a distribution manner, so that there was no case where the residual toner was concentrated at a single process cartridge.

However, in the operation in the monochromatic mode, other color process cartridges are separated from the intermediary transfer member and are stopped and therefore all the residual toner is collected in the process cartridge used in the operation in the monochromatic mode.

Here, in the color image forming apparatus of the in-line type, a proportion of the residual toner collected in the respective color process cartridges will be described. The first, second, third and fourth stations are disposed in this order from an upstream side with respect to a rotational direction of the intermediary transfer member. Each of the stations is provided with the process cartridge for an associated color. First, during the normal image formation, there is substantially no difference in general in amount of the transfer, generated when the toner image is transferred onto the intermediary transfer member, between the respective stations.

When the toner image transferred on the intermediary transfer member at a certain station (e.g., the first station) passes through the downstream second, third and fourth stations, a phenomenon (reverse transfer) such that the toner image is transferred from the intermediary transfer member onto each station somewhat occurs. Therefore, the amount of the residual toner collected by the reverse transfer is large at the fourth station.

The black process cartridge used in the operation in the monochromatic mode is disposed as the fourth station in many cases. This is because a distance from a position where the toner image is transferred onto the intermediary transfer member to a position where the toner image is transferred from the intermediary transfer member onto the toner image receiving material is short when the printing operation in the monochromatic mode is performed at the fourth station, and therefore a time from start of an image forming operation by the image forming apparatus until the first toner image receiving material is outputted is shortened.

As described above, with respect to the black process cartridge disposed at the fourth station, due to the increase in amount of the collected toner by the reverse transfer and the increase in frequency of the operation in the monochromatic mode, such a phenomenon that the amount of the collected toner exceeds the volume of the collected toner container and thus the collected toner overflows (overflow phenomenon) is caused to occur. When the collected toner overflows from the collected toner container, there arises a problem such that the image forming apparatus is contaminated with the collected toner or the collected toner is scattered to the outside of the image forming apparatus.

SUMMARY OF THE INVENTION

The present invention has been accomplished by solving this problem. A principal object of the present invention is to provide an image forming apparatus of an in-line type capable of preventing an overflow phenomenon of residual toner at an image forming portion used in an operation in a single-color image forming mode.

According to an aspect of the present invention, there is provided an image forming apparatus comprising: a first image bearing member for bearing a toner image; a second image bearing member for bearing a toner image; an intermediary transfer member onto which the toner images formed on the first and second image bearing members are capable of being primary-transferred, wherein the first and second image bearing members are provided along a movement direction of the intermediary transfer member; a secondary transfer member for transferring the toner images from the intermediary transfer member onto a recording material; a toner charging member, provided downstream of the secondary transfer member and upstream of the upstream-most image bearing member with respect to the movement direction of the intermediary transfer member, capable of electrically charging a toner transferred on the intermediary transfer member; and a controller for controlling an operation in a single-color image forming mode in which the toner image formed on the first image bearing member is transferred onto the intermediary transfer member to effect image formation in a state of contact between the first image bearing member and the intermediary transfer member and in a state of separation between the second image bearing member and the intermediary transfer member and for controlling an operation in a multi-color image forming mode in which the toner images formed on the first and second image bearing members are transferred onto the intermediary transfer member to effect image formation in a state of contact between the first image bearing member and the intermediary transfer member and in a state of contact between the second image bearing member and the intermediary transfer member, wherein the controller effects, in a post-processing operation after the image formation in the operation in the single-color image forming mode is ended, control such that the state of separation between the second image bearing member and the intermediary transfer member is switched to the state of contact between the second image bearing member and the intermediary transfer member and the toner deposited on the toner charging member is collected onto the second image bearing member via the intermediary transfer member and then is collected by a cleaning device provided for the second image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

(1) Structure of Image Forming Apparatus

Figure 1:
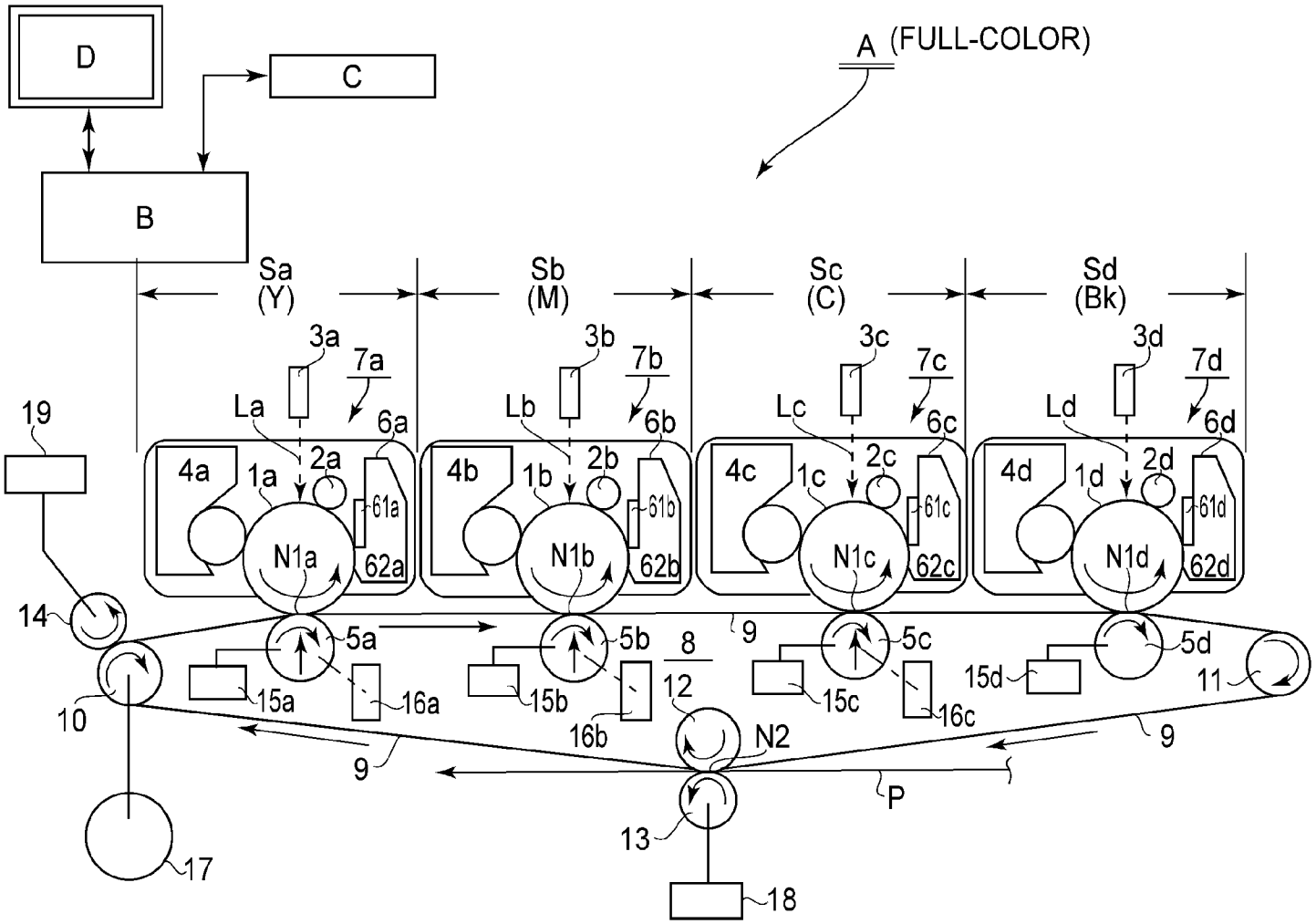
FIG. 1 is an illustration of an image forming apparatus of an intermediary transfer in-line type (full-color mode) in Embodiment 1.

FIG. 1 is a schematic structural view of a principal part of an image forming apparatus A in this embodiment. The apparatus A is an electrophotographic color laser beam printer of an intermediary transfer in-line type. The image forming apparatus A is capable of executing an operation in a multicolor image forming mode in which a plurality of color images are formed on a recording material (toner image receiving material) P on the basis of electrical image information (image signal) inputted from a host device D into a control circuit portion (controller) B and an operation in a single-color image forming mode in which a single-color image (principally a black image) is formed. The recording material P is a recording medium capable of forming the toner image and is a sheet-like member such as a sheet, an OHP sheet, a label or a cloth.

Figure 7:
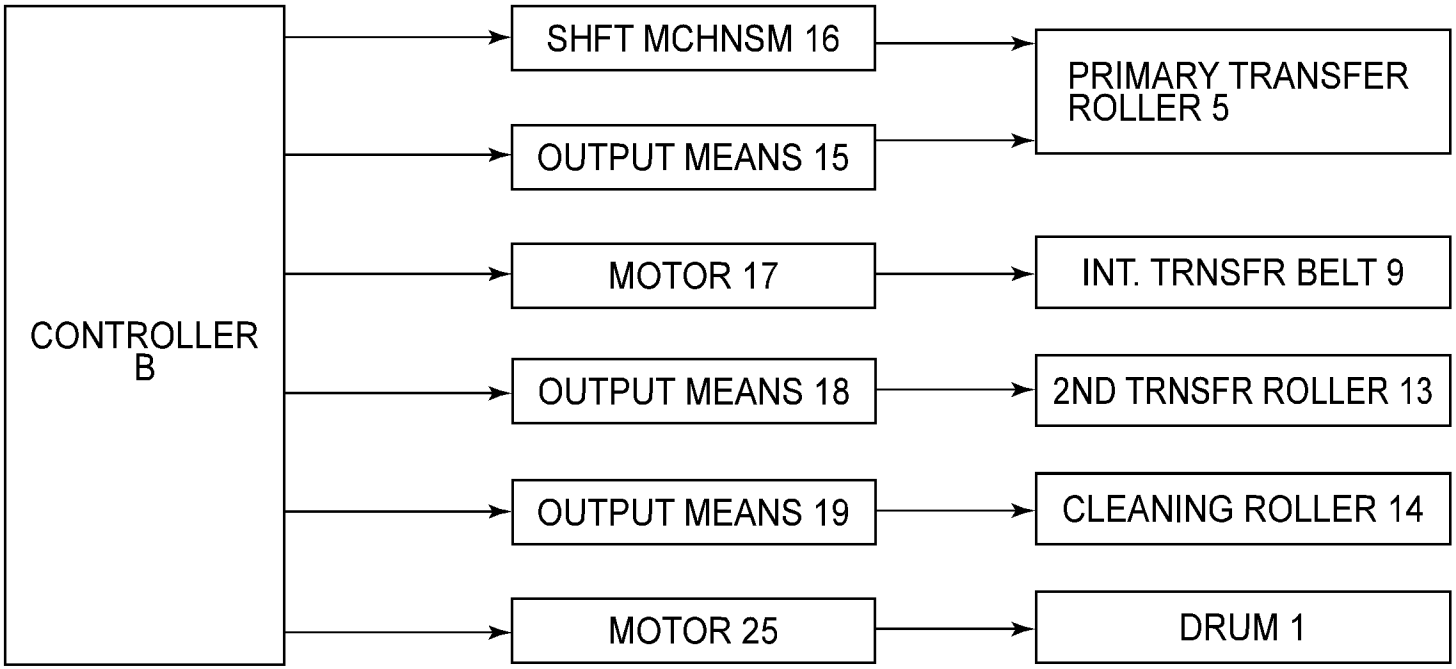
FIG. 7 is a block diagram of a control circuit portion B in Embodiment 1.

The host device D is an image reading device (image reader), a personal computer (PC), a terminal on the network, a remote facsimile machine, a word processor or the like and is connected to the control circuit portion B via an interface portion. The control circuit portion B effects transfer of various pieces of electrical information between itself and the host device D or an operating portion (control panel) C including a display portion or the like. Further, the control circuit portion B monitors and controls operations of various devices in the apparatus A, thus controlling a print operation (image forming operation) of the apparatus A in a centralized manner in accordance with a predetermined control program or a predetermined reference table, thus controlling image forming operations in a monochromatic mode and the full-color mode. The control circuit portion B controls a motor 17, a shift mechanism 16, a transfer voltage output means 15, a voltage output means 18, a charge voltage output means 19 and a main motor 25 (FIG. 7).

In the apparatus A, a plurality of image forming portions, i.e., first to fourth (four) image forming portions (hereinafter referred to as stations) S (Sa, Sb, Sc, Sd) are juxtaposed in a horizontal direction from left to right on the drawing sheet in this embodiment and form respective color toner images by parallel processing. The respective stations Sa, Sb, Sc and Sd are electrophotographic image forming mechanisms having the same constitution except that the colors of developers (toners) accommodated in associated developing devices are yellow (Y), magenta (M), cyan (C) and black (Bk), respectively, which are different from each other.

The constitution and an operation are common to the first to fourth stations with respect to many portions. Therefore, in the following description, in the case where there is no need to particularly differentiate the stations, suffixes, a, b, c and d which indicate elements (portions) provided for associated colors are omitted and will be collectively described. The respective stations S include rotatable drum-type electrophotographic photosensitive members (drums) 1, as image bearing members, on which toner images of different colors of Y, M, C and Bk in this embodiment are to be formed. Each drum 1 is rotationally driven in the counterclockwise direction indicated by an arrow at a predetermined speed by a driving means (main motor 25 in FIG. 7) of the apparatus 100. Around the drum 1, as process means acting on the drum 1, a charging device 2, an exposure device 3, a developing device 4, a primary transfer device 5 and a cleaning device 6 are provided.

The charging device 2 is a charging means for uniformly charging a surface of the drum 1 to a predetermined polarity and potential. In this embodiment, a charging roller (primary charger: electroconductive roller) is used. In this embodiment, the drum 1 is uniformly charged to a predetermined negative potential by the charging roller 2 to which a predetermined charging bias is applied. The exposure device 3 is an image exposure means for scanning-exposing the surface of the drum 1 to light which is modulated depending on the image information. In this embodiment, a laser scanner unit is used to output laser light L modulated in accordance with the image information, thus scanning-exposing the charged surface of the drum 1 to the laser light L. By the above charging and exposure, an electrostatic image (latent image) depending on the image information is formed on the surface of the drum 1. The developing device 4 is a developing means for developing and visualizing the electrostatic latent image formed on the surface of the drum 1 as a toner image (developer image). In the developing device 4*a* of the station Sa, the toner of yellow (Y) is accommodated. In the developing device 4*b* of the second station Sb, the toner of magenta (M) is accommodated. In the developing device 4*c* of the third station Sc, the toner of cyan (C) is accommodated. In the developing device 4*d* of the fourth station Sd, the toner of black (Bk) is accommodated. The cleaning device 6 is a cleaning means for removing primary transfer residual toner from the surface of the drum 1.

In this embodiment, the developing device 4 develops the electrostatic image by a reverse positioning method. That is, the developing device 4 deposits the toner charged to the normal polarity (negative in this embodiment) identical to the charge polarity of the drum 1 on a portion (exposed light portion) of the drum 1 where the electric charge is attenuated by the exposure after the charging, so that the toner image is formed on the drum 1. The developing device 4 is not limited to this developing device but as the developer, the developing device 4 may suitably use, e.g., a non-magnetic one-component developer, i.e., the toner.

The drum transfer device (primary transfer means) 5 is a primary transfer roller (electroconductive roller) in this embodiment and is provided correspondingly to the lower surface of an intermediary transfer belt of an intermediary transfer unit 8 described later. Further, the belt 9 is contacted to the lower surface of the belt to form a primary transfer portion (primary transfer nip) N1 where the toner image on the drum 1 is primary-transferred onto the surface of the belt 9.

The cleaning device 6 includes a cleaning blade 61, as a drum cleaning member, for scraping and removing the toner from the surface of the drum 1 and a residual toner container 62 for collecting the toner removed by the blade 61.

In the apparatus A in this embodiment, at each station S, the drum 1, the charging roller 2, the developing device 4 and the cleaning device 6 are integrally assembled into a cartridge to be constituted as a process cartridge 7. The cartridge 7 is detachably mountable to an image forming apparatus main assembly. Therefore, by exchanging the cartridge 7, the residual toner container 62 in which the residual toner or the like is collected can also be exchanged together.

Incidentally, the process cartridge 7 is prepared by integrally assembling the electrophotographic photosensitive member and at least one of the charging means, the developing means and the cleaning means, as the process means acting on the electrophotographic photosensitive member, into a cartridge which is detachably mountable to the image forming apparatus main assembly. Further, each of the developing device 4 and the cleaning device 6 can also be formed into a cartridge singly or in a pair with another device so as to be detachably mountable to the apparatus main assembly.

At a lower portion of the four (first to fourth) stations Sa, Sb, Sc and Sd, the intermediary transfer unit 8 is provided. The unit 8 includes a flexible endless intermediary transfer belt (endless belt-like film) 9 as the intermediary transfer member which is circulated and moved to be subjected to the transfer of the toner image from each station S. The belt 9 is formed of, e.g., a fluorine-containing resin, a polycarbonate resin, a polyimide resin or the like. Further, as the belt 9, it is also possible to use an elastic belt including all of or a part of layers formed with an elastic member.

The belt 9 is stretched around a driving roller 10, a tension roller 11 and a secondary transfer opposite roller 12 which are used as a plurality of supporting members (belt stretching members). The roller 10 is provided at the first station Sa side. The roller 11 is provided at the fourth station Sd side. The roller 12 is provided between and below the rollers 10 and 11. An upper belt portion between the rollers 10 and 11 extends at the lower portion of the first to fourth stations Sa, Sb, Sc and Sd.

The belt 9 is rotated (circulation-moved) in the clockwise direction (intermediary transfer member movement direction) indicated by arrows at the substantially same peripheral speed (surface movement speed) as that of the drum 1 by driving the roller 10 by the motor (belt driving means) 17 controlled by the control circuit portion B. Therefore, in this embodiment, with respect to the movement direction of the upper belt portion between the rollers 10 and 11, the first station Sa for yellow (Y) is the upmost station and the fourth station Sd for black (Bk) is the downstreammost station. In other words, in the case where a multi-color image is formed, the station Sa for forming a first color toner image is the upmost station and the station Sd for forming a final color toner image is the downstreammost station. As for the drum 1, the drum 1*a* is the upmost image bearing member and the drum 1*d* is the downstreammost image bearing member.

The primary transfer roller 5 at each station S is disposed inside the belt 9. To each roller 5, a transfer voltage output means 15 for applying a voltage is electrically connected. The transfer voltage output means 15 is controlled by the control circuit portion B.

Further, each of the rollers 5*a*, 5*b* and 5*c* at the first to third stations Sa, Sb and Sc is constituted so as to be positionally changed (moved) between a raised position (FIG. 1) and a lowered position (FIG. 2) by an associated shift mechanism 16*a*, 16*b* or 16*c* as a state changing means. Each of the shift mechanisms 16*a*, 16*b* and 16*c* is controlled by the control circuit portion B. Although a specific example of the shift mechanism 16 is omitted from illustration in order to avoid complicatedness of illustration, e.g., an appropriate mechanism using a lever and a cam or using a solenoid can be used. The shift mechanism 16 can also be constituted so that the rollers 5*a*, 5*b* and 5*c* are supported by a common supporting member and the common supporting member is swung.

The rollers 5*a*, 5*b* and 5*c* keep the belt 9 in a state of contact to the lower surfaces of the drums 1*a*, 1*b* and 1*c*, respectively, by being state-changed to their raised positions to raise the belt 9 against the tension. As a result, at the first to third stations Sa, Sb and Sc, the primary transfer portions (primary transfer nips) N1*a*, N1*b* and N1*c*, respectively, which are the contact portion between the drum 1 and the belt 9 are formed (FIG. 1).

Figure 2:
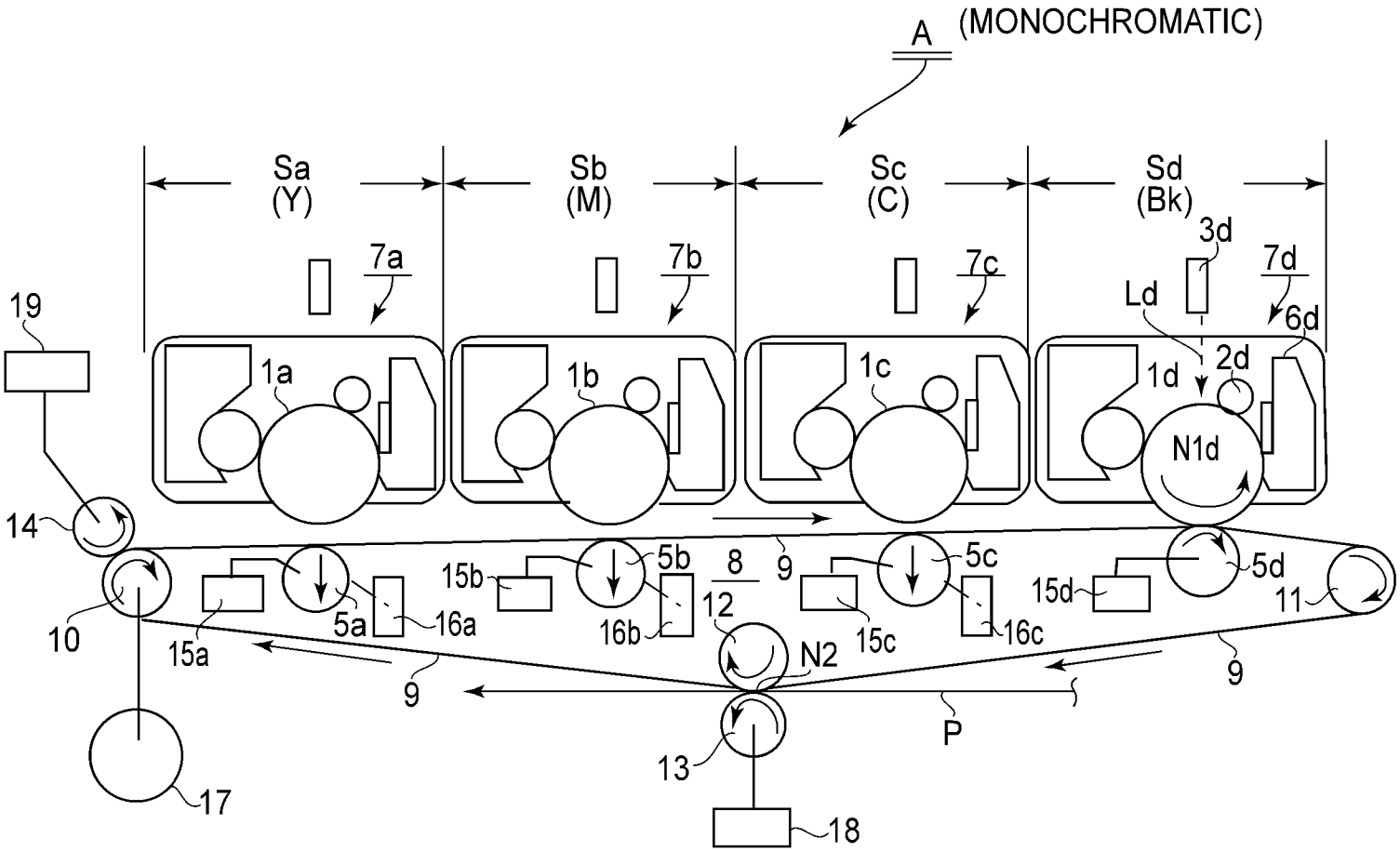
FIG. 2 is an illustration showing a state in which image forming portions and an intermediary transfer member are separated in an operation in a monochromatic mode.

Further, the rollers 5*a*, 5*b* and 5*c* are state-changed to their lowered positions, whereby urging of the belt 9 against the drums 1*a*, 1*b* and 1*c* is released. As a result, the belt 9 is lowered, so that the belt 9 is held in a separation state (in which the primary transfer portions N1*a*, N1*b* and N1*c* are eliminated) in which the belt 9 is separated from the drums 1*a*, 1*b* and 1*c* (FIG. 2). Even in the separation state in which each of the rollers 5*a*, 5*b* and 5*c* is state-changed to the lowered position, the belt 9 is kept in a tension state by the action of the tension roller 11.

In this embodiment, as for the roller 5*d* at the fourth station Sd for Bk, the roller 5*d* is always kept in the state of contact to the lower surface of the belt 9 toward the drum 1*d*. Also with respect to this roller 5*d*, it is possible to employ the constitution in which the roller 5*d* is positionally changed between the raised position and the lowered position by the shift mechanism 16. The fourth station Sd for Bk is disposed at the downstreammost side with respect to the movement direction of the belt 9. This is because a distance from a position of the transfer of the toner image onto the belt 9 until the transfer of the toner image onto the toner image receiving material (recording material) becomes short when the roller 5*d* is disposed at the downstreammost side and therefore a time from start of the image forming operation of the image forming apparatus until a first recording material is outputted is shortened.

To the secondary transfer opposite roller 12, the belt 9 is press-contacted by a secondary transfer roller (secondary transfer member) 13 which is an electroconductive roller as a secondary transfer means. As a result, a secondary transfer portion (secondary transfer nip) N2 which is a contact portion between the belt 9 and the roller 13 is formed. Further, to the roller 13, a voltage output means 18 for applying a voltage is electrically connected. The voltage output means 18 is controlled by the control circuit portion B.

At a belt contact portion of the roller 10, a cleaning roller (electroconductive roller) 14 as a toner charging member (intermediary transfer member cleaning means) for imparting an electric charge to the toner deposited on the belt 9 is provided in contact to the belt 9. That is, the roller 14 is disposed downstream of the roller 13 and upstream of the upstreammost first station Sa of the plurality of stations Sa, Sb, Sc and Sd with respect to the movement direction of the belt 9 (intermediary transfer member movement direction). To the roller 14, a charge voltage output means 19 for applying a voltage is electrically connected so as to be capable of charging the toner on the belt 9. The charge voltage output means 19 is controlled by the control circuit portion B.

(2) Full-Color Mode (Multi-Color Image Forming Mode)

An operation for forming a full-color image is as follows. The control circuit portion B executes the following apparatus operation on the basis of an input of an image formation start signal. The control circuit portion B actuates a driving means of the apparatus A kept in a stand-by (ready) state in which the driving means (unshown driving motor) is in rest although the main switch (not shown) is turned on, thus executing a predetermined warming-up operation (pre-rotation operation) of the apparatus A.

During the warming-up operation, when the rollers 5*a*, 5*b* and 5*c* are located at their lowered positions as shown in FIG. 2, the control circuit portion B controls the shift mechanisms 16*a*, 16*b* and 16*c* to move these rollers to their raised positions as shown in FIG. 1. As a result, the belt 9 is placed in the contact state to all the drums 1 of the first to fourth stations Sa, Sb, Sc and Sd to form the primary transfer portions N1*a*, N1*b*, N1*c* and N1*d*.

After the control circuit portion B executes the predetermined warming-up operation of the apparatus A, the apparatus operation goes to an image forming operation (printing operation) for executing an inputted print job (image forming job).

At each station S, the charging device 2 uniformly charges the surface of the rotationally driven drum 1 to the predetermined polarity and potential with predetermined control timing. Each unit 3 scanning-exposes the surface of the drum 1 with the laser light L which is modulated depending on the image information of an associated color. As a result, the electrostatic latent image depending on the image information of the associated color is formed on the surface of the drum 1 with predetermined control timing. Then, the electrostatic image is developed as the toner image by the developing device 4.

By the electrophotographic image forming process operation as described above, a Y (yellow) toner image corresponding to a Y component of the full-color image is formed on the drum 1*a* of the first station Sa in the apparatus A in this embodiment. Then the toner image is primary-transferred onto the surface of the moving belt 9 at the primary transfer portion N1*a*. An M (magenta) toner image corresponding to an M component of the full-color image is formed on the drum 1*b* of the second station Sb. The toner image is primary-transferred superposedly onto the Y toner image, at the primary transfer portion T1M, which has already been transferred onto the belt 9. A C (cyan) toner image corresponding to a C component of the full-color image is formed on the drum 1*c* of the third station Sc and then, at the primary transfer portion N1*c*, is primary-transferred superposedly onto the Y and M toner images which have already been transferred onto the belt 9. A K (black) toner image corresponding to a K component of the full-color image is formed on the drum 1*d* of the station Sd. Then, the toner image is primary-transferred superposedly onto the Y, M and C toner images, at the primary transfer portion N1*d*, which have already been transferred onto the belt 9.

At each station S, the primary transfer from the drum 1 onto the belt 9 is performed by applying a predetermined bias for the primary transfer to the roller 5 from the transfer voltage output means 15 with predetermined control timing. By this primary transfer bias application, at the primary transfer portion N1, an electric field in a direction (polarity) in which the toner charged to the normal charge polarity (negative in this embodiment) is moved from the drum 1 toward the belt 9 is formed. In the primary transfer step, the toner (residual toner) remaining on the drum 1 without being transferred on the belt 9 is removed and collected by the cleaning device 6.

Thus, full-color unfixed toner image based on the four colors of Y, M, C and Bk is synthetically formed. Here, in the apparatus A in this embodiment, the color toner images Y, M, C and Bk are successively primary-transferred superposedly onto the belt 9 in this order. However, the order may appropriately be changed.

On the other hand, a sheet of the recording material P separated and fed from a sheet feeding mechanism portion (not shown) is introduced into the secondary transfer portion N2 with predetermined control timing synchronized with the superposed four color toner images on the belt 9. As a result, the superposed four color toner images are collectively secondary-transferred from the belt 9 onto the recording material P nip-conveyed through the secondary transfer portion N2.

This secondary transfer is, during the nip-conveyance of the recording material P through the secondary transfer portion N2, made by applying a predetermined bias for the secondary transfer from the voltage output means 18 to the roller 13. By this secondary transfer bias application, at the secondary transfer portion N2, an electric field in a direction (polarity) in which the toner charged to the normal charge polarity (negative in this embodiment) is moved from the belt 9 toward the recording material P is formed.

The recording material P which passes through the secondary transfer portion N2 in which it is subjected to the toner image transfer is separated from the belt 9 and then is introduced into a fixing device (not shown). The fixing device heats the toner images on the recording material P to fix the toner images as a fixed image. That is, the toner images of the plurality of colors collectively transferred on the recording material P are melt-mixed and fixed on the recording material P to form a full-color image on the recording material P. Then, the image-fixed recording material P is discharged, as a full-color image-formed product, to the outside of the apparatus A.

The toner (residual toner) remaining on the belt 9 without being transferred on the recording material P in the secondary transfer step is reversely transferred from the belt 9 onto the drum 1 at the primary transfer portion N1 of the station S by further movement of the belt 9. Then, the residual toner is removed and collected by the cleaning device 6 of the station S.

Typically, to the residual toner on the belt 9, the electric charge is imparted by the cleaning roller 14 provided upstream of the secondary transfer portion N2 and downstream of the primary transfer portion N1*a* of the first station Sa with respect to the movement direction of the belt 9. Then, the residual toner is reversely transferred onto the drum 1 at the primary transfer portion N1 of the station S during subsequent primary transfer. The residual toner deposited on the drum 1 at that time is then removed and collected by the cleaning device 7.

The control circuit portion B transfers, when the image forming operation (a series of image forming operation steps on a single or a plurality of recording materials on the basis of the image formation start command (signal)) for a set predetermined print job is ended, the apparatus operation to a predetermined ending operation (post-processing operation) executed after the image forming operation. Then, when the predetermined ending operation is ended, the control circuit portion B stops the driving means and places the apparatus A in a stand-by state in which the apparatus A is ready for input of a subsequent image formation start signal.

Here, the time of the end of the image forming operation of the apparatus is the time when a trailing end of the toner image formed on the drum 1 by a final image forming operation for the predetermined print job is transferred onto the belt 9 at the primary transfer portion N1 of each of the stations S. From the time, the ending operation is performed at each of the stations S.

(3) Monochromatic Mode (Single-Color Image Forming Mode)

In an operation in the monochromatic mode, the image is formed by using only one station S of the first to fourth stations Sa, Sb, Sc and Sd. In this embodiment, the operation in the monochromatic mode (monochromatic printing) in which the image of Bk is formed by using only the fourth station Sd for Bk will be described.

The control circuit portion B transfers, on the basis of the input of the image formation start signal, the apparatus operation to a predetermined warming-up operation by actuating the driving means for the apparatus A kept in the stand-by state. In this embodiment, only the drum 1*d* of the fourth station Sd for Bk is rotationally driven. As for the unit 3, only the unit 3*d* of the fourth station Sd is driven. Further, the motor 17 is actuated to rotationally drive the belt 9.

During the warming-up operation, when the rollers 5*a*, 5*b* and 5*c* of the first to third stations Sa, Sb and Sc other than the fourth station Sd are located at their raised positions (FIG. 1), the control circuit portion B controls the shift mechanisms 16*a*, 16*b* and 16*c* to move these rollers to their lowered positions (FIG. 2). As a result, the belt 9 is separated from the drums 1 of the first to third stations Sa, Sb and Sc to be placed in a state in which the primary transfer portions N1*a*, N1*b* and N1*c* are not formed. To the drum 1*d* of the fourth station Sd, the belt 9 is contacted, so that a state in which the primary transfer portion N1*d* is formed is creased.

The control circuit portion B transfers, after the predetermined warming-up operation of the apparatus A is ended, the apparatus operation to an image forming operation for executing an inputted print job. In this operation in the monochromatic mode, at the first to third stations Sa, Sb and Sc, the rotational drive of the drums 1 is not effected and the image forming operation is kept in a rest (stop) state. Only at the fourth station Sd, the rotational drive of the drum 1*d* is effected and the image forming operation for forming the Bk toner image is executed.

That is, at the fourth stations Sd, the charging device 2*d* uniformly charges the surface of the rotationally driven drum 1*d* to the predetermined polarity and potential with predetermined control timing. The unit 3*d* scanning-exposes the surface of the drum 1*d* with the laser light Ld which is modulated depending on the image information of the black. As a result, the electrostatic latent image depending on the image information of the black is formed on the surface of the drum 1*d* with predetermined control timing. Then, the electrostatic image is developed as the black (Bk) toner image by the developing device 4*d*.

The Bk toner image is primary-transferred onto the surface of the belt 9 at the primary transfer portion N1*d* and then is secondary-transferred onto the recording material P at the secondary transfer portion N2. The recording material P which passes through the secondary transfer portion N2 in which it is subjected to the Bk toner image transfer is separated from the belt 9 and then is introduced into the fixing device. The fixing device heats the Bk toner image on the recording material P to fix the Bk toner image as a fixed image. Then, the image-fixed recording material P is discharged, as a monochromatic image-formed product, to the outside of the apparatus A.

The toner (residual toner) remaining on the drum 1*d* without being transferred on the belt 9 in the primary transfer step is removed and collected by the cleaning device 6*d*. Further, the toner (residual toner) remaining on the belt 9 without being transferred on the recording material P in the secondary transfer step is conveyed to the primary transfer portion N1*d* of the station Sd by further movement of the belt 9 and is reversely transferred from the belt 9 onto the drum 1*d*. Then, the residual toner is removed and collected by the cleaning device 6 of the station S.

Typically, to the residual toner on the belt 9, the electric charge is imparted by the cleaning roller 14 and the residual toner is reversely transferred onto the drum 1*d* at the primary transfer portion N1*d* of the station Sd during subsequent primary transfer. The residual toner deposited on the drum 1*d* at that time is then removed and collected by the cleaning device 7*d*.

The control circuit portion B transfers, when the image forming operation for a set predetermined print job in the monochromatic mode is ended, the apparatus operation to a predetermined ending operation executed after the image forming operation. Then, when the predetermined ending operation is ended, the control circuit portion B stops the driving means and places the apparatus A in a stand-by state in which the apparatus A is ready for input of a subsequent image formation start signal.

As described above, during the operation in the monochromatic mode, at the first to third stations Sa, Sb and Sc other than the fourth station Sd for Bk, the drive of the drums 1*a*, 1*b* and 1*c* and the image forming operation are stopped and the drums 1 and the belt 9 are placed in the separation state. As a result, the lifetimes of the developing devices 4*a*, 4*b* and 4*c* and the drums 1*a*, 1*b* and 1*c* at the first to third stations Sa, Sb and Sc are not spent, so that the image forming operation only at the fourth station Sd for Bk can be performed.

Here, the single-color image forming mode is not limited to the above-described mode using only the fourth station Sd for Bk. By a selection designation operation, it is also possible to employ a mode using only any one of the first station Sa for Y, the second station Sb for M and the third station Sc for C. In the latter case, also at the fourth station Sd, the device constitution such that the drum 1*d* and the belt 9 can be shifted between the contact state and the separation state by the shift mechanism is employed.

(4) Cleaning of Belt 9

Next, a cleaning method of cleaning the belt 9 will be described in detail. The control circuit portion B applies, during the image forming operation of the apparatus A, the bias voltage of the positive polarity opposite to the negative polarity as the normal toner charge polarity from the charge voltage output means 19 to the roller 14. In this embodiment, as the positive bias voltage, an oscillating voltage in the form of a DC voltage is biased with a rectangular waveform of 1000 Hz in frequency and 2000 V in peak-to-peak voltage. As a result, the positive electric charge is imparted to the residual toner remaining on the belt 9 without being secondary-transferred. Further, during the image forming operation, in order to attract the toner from the drum 1 to the primary transfer roller 5, the bias voltage of the positive polarity opposite to the negative polarity as the normal charge polarity of the toner.

Therefore, the residual toner, on the belt 9, charged to the positive polarity by the roller 14 is reversely transferred onto the drum 1 of the station S during subsequent primary transfer and then is removed and collected by the cleaning device 6 of the station S.

1) During the image forming operation in the full-color mode (FIG. 1), the residual toner on the belt 9 is substantially all collected at the upstreammost first station Sa of the first to fourth stations Sa, Sb, Sc and Sd. This is because the method in which the residual toner is collected by the reverse transfer simultaneously with the primary transfer is employed and therefore the collection of the residual toner at the upstreammost first station Sa is preferable.

2) During the image forming operation in the monochromatic mode (FIG. 2), at the first to third stations Sa, Sb and Sc for Y, M and C other than the fourth station Sd for Bk, the image forming operation is not performed and the drum 1 and the belt 9 are spaced. Therefore, the residual toner on the belt 9 is all collected at the fourth station Sd. Also in this case, similarly as described above, the method in which the residual toner is collected by the reverse transfer simultaneously with the primary transfer is employed.

(5) Cleaning of Roller 14

The toner on the belt 9 before the secondary transfer step is generally charged to the negative polarity as the normal charge polarity of the toner. However, in the secondary transfer step, to the secondary transfer roller 13, the bias voltage of the positive polarity opposite to the negative polarity as the normal toner charge polarity is applied in order to attract the toner from the belt 9 to the recording material P. For that reason, by the influence of this positive bias voltage, on the belt 9 after the secondary transfer, the toners of the both (positive and negative) polarities are present. Further, the positive bias voltage is also applied to the roller 14 and therefore the negative residual toner which is not completely charged to the positive polarity is liable to be deposited on the roller 14 (toner contamination of roller 14).

Therefore, in order to clean the roller 14, the control circuit portion B moves the residual toner deposited on the roller 14 toward the belt 9 after the image forming operation for the set predetermined print job is ended. The control circuit portion B executes control for removing and collecting the moved toner at the station S.

Specifically, in this embodiment, the control circuit portion B moves, with predetermined timing during the non-image formation of the apparatus, the residual toner deposited on the roller 14 toward the belt 9 during the ending operation after the image forming operation for the set predetermined print job is ended. This toner movement is made by applying a toner movement bias from the charge voltage output means 19 to the roller 14.

This bias is a voltage of a predetermined potential and of the same polarity as the charge polarity of the toner deposited on the roller 14. In this embodiment, the voltage of −1.5 kV is applied. As a result, the negative toner deposited on the roller 14 is moved onto the belt 9 to effect the cleaning of the roller 14.

The residual toner deposited on the belt 9 can be reversely transferred and collected onto the drum 1 by applying, to the primary transfer roller 5, the bias voltage of the negative polarity opposite to the positive polarity during the image forming operation (i.e., identical to the normal toner charge polarity).

1) During the operation in the full-color mode, the toner moved from the roller 14 to the belt 9 is passed through the primary transfer portion N1*a* of the first station Sa and then is substantially equally collected at the second and third stations Sb and Sc.

In this case, the control circuit portion B applies, to the primary transfer roller 5*a* of the first station Sa, the bias of a predetermined potential and of the polarity opposite to the normal toner charge polarity from the transfer voltage output means 15*a*. As a result, at the primary transfer portion N1*a*, the toner of the normal charge polarity moved from the roller 14 to the belt 9 is passed through the primary transfer portion N1*a* while being attracted to the belt 9 without being reversely transferred onto the drum 1*a*.

On the other hand, the control circuit portion B applies the bias, of a predetermined polarity and of the polarity identical to the normal charge polarity of the toner, from the primary transfer voltage output means 15*b* and 15*c* to the primary transfer rollers 5*b* and 5*c* of the second and third stations Sb and Sc. As a result, at the primary transfer portions N1*b* and N1*c*, the toners which pass through the primary transfer portion N1*a* and have the normal charge polarity on the belt 9 are reversely transferred onto the drums 1*b* and 1*c*. The toners reversely transferred on the drums 1*b* and 1*c* are collected by the cleaning devices 6*b* and 6*c*.

Under the above setting, the toner moved from the roller 14 to the belt 9 is passed through the primary transfer portion N1*a* of the first station Sa and can be collected substantially equally at the second and third stations Sb and Sc.

2) Also during the operation in the monochromatic mode, similarly as during the operation in the full-color mode, in the ending operation after the image forming operation for the predetermined print job is ended, there is a need to effect the control for moving the residual toner, deposited on the roller 14, to the belt 9. In this embodiment, during the ending operation in the monochromatic mode, the toner moved (discharged) from the roller 14 to the belt 9 is collected at the station which is not used in the operation in the monochromatic mode.

Specifically, the control circuit portion B applies the toner movement (discharging) bias from the toner charge voltage output means 19 to the roller 14 during the ending operation after the image forming operation for the set predetermined print job is ended. Further, the drums 1*a*, 1*b* and 1*c* of the first to third stations Sa, Sb and Sc are rotationally driven at a predetermined speed and at the same time, the shift mechanisms 16*a*, 16*b* and 16*c* are collected to move the primary transfer rollers 5*a*, 5*b* and 5*c* from the lowered positions to the raised positions.

As a result, the belt 9 is contacted to the drums 1*a*, 1*b* and 1*c* of the first to third stations Sa, Sb and Sc to form the state in which the primary transfer portions N1*a*, N1*b* and N1*c* are formed.

Thereafter, the same control as that of the cleaning of the roller 14 during the operation in the full-color mode as in 1) described above. As a result, the toner discharged from the roller 14 onto the belt 9 is passed through the first station Sa and can be substantially equally collected at the second and third stations Sa and Sb. Incidentally, at the first station Sa where the toner is not collected from the belt 9, the primary transfer roller 5*a* may also be kept at the lowered position to prevent the belt 9 from being contacted to the drum 1*a*. Thus, the belt 9 is prevented from being contacted to the drum 1*a*, so that deterioration of the drum 1*a* due to the friction between the drum 1*a* and the belt 9 can be suppressed. In this embodiment, the reason why the toner is not collected at the first station Sa is that the residual toner during the image formation in the operation in the full-color mode is collected at the first station Sa. For that reason, when the collection of the toner from the roller 14 is effected at the first station Sa, there is a possibility that the residual toner overflows the residual toner container 62*a*. Incidentally, when the residual toner container 62*a* has a sufficient volume for the residual toner, the toner may also be collected at the first station Sa.

Figure 8:
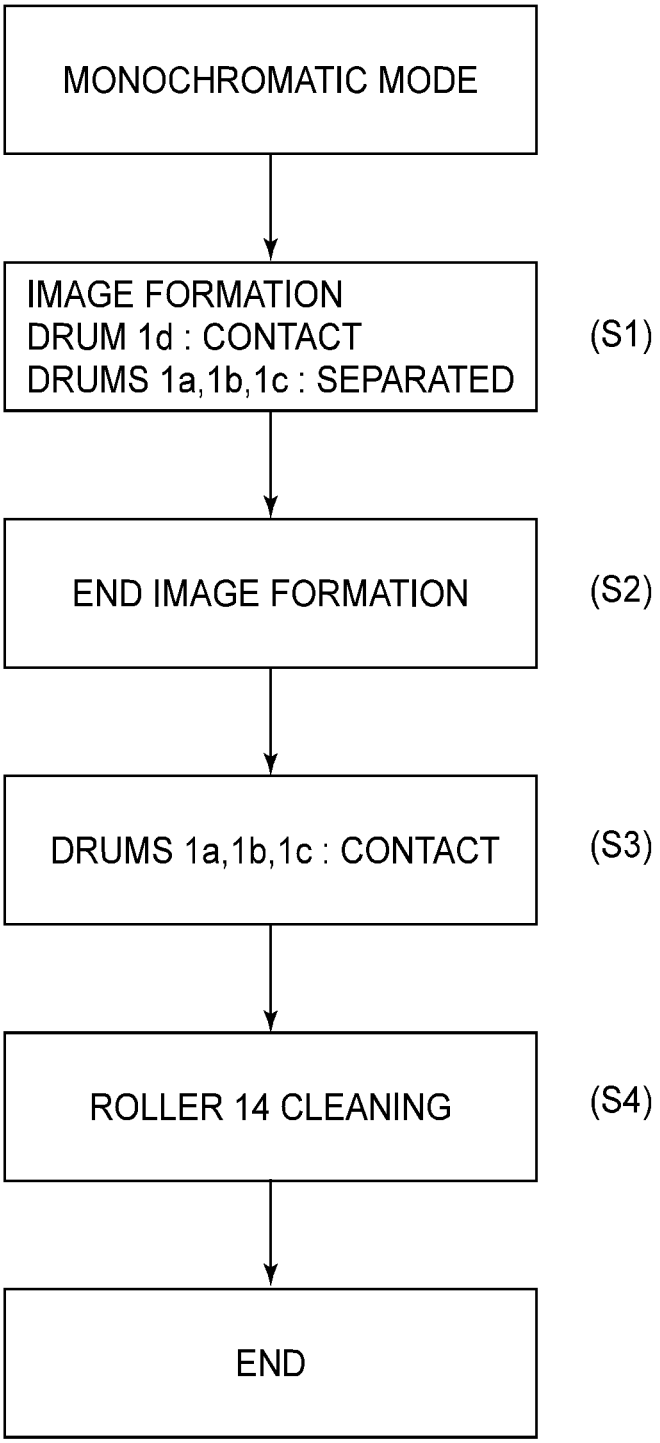
FIG. 8 is a flow chart of image formation in Embodiment 1.

An image formation flow in this embodiment will be described with reference to FIG. 8.

When the monochromatic mode is selected, the drum 1*d* on which the toner image is to be formed is placed in the state of contact to the belt 9 and other drums 1*a*, 1*b* and 1*c* are placed in the state of separation from the belt 9. In these states, image formation is effected (S1). When the image forming operation is ended (S2), the belt 9 is contacted to the drums 1*a*, 1*b* and 1*c* for performing a cleaning operation of the roller 14 (S3). Then, the toner is moved from the roller 14 onto the belt 9 and is collected by the drums 1*b* and 1*c* to clean the roller (S4).

As described above, the toner discharged (moved) from the roller 14 onto the belt 9 in the operation in the monochromatic mode is collected also at the second and third stations Sb and Sc. As a result, overflow (such a phenomenon that the amount of the residual toner exceeds the volume of the residual toner container 62*d* of the cleaning device 6*d* and thus the residual toner overflows the residual toner container 62*d*) of the residual toner at the fourth station Sd can be prevented.

The timing when the belt 9 is contacted to the drum 1 of the station S which is not used is after a trailing end of the toner image formed on the belt 9 at the station for the single-color image formation passes through the transfer portion N1 of the station where the belt 9 is intended to be contacted to the drum 1.

Further, the control of the contact state and the separation state between the drum 1 and the belt 9 at each station S can also be effected as follows.

(a) During the stand-by state of the apparatus A, at all the stations, the drum 1 and the belt 9 are placed in the contact state. Then, in the operation in the single-color image forming mode, at the stations which are not used, the state between the drum 1 and the belt 9 is changed to the separation state. When the operation in the single-color image forming mode is ended, the state between the drum 1 and the belt 9 at the stations which are not used are returned to the contact state, so that these stations are in the stand-by state.

(b) During the stand-by state of the apparatus A, at all the stations, the drum 1 and the belt 9 are placed in the separation state. Then, in the operation in the full-color mode, the state between the drum 1 and the belt 9 at all the stations is changed to the contact state. When the operation in the full-color mode is ended, the state between the drum 1 and the belt 9 at all the stations is returned to the separation state, so that all the stations are in the stand-by state. Further, in the case of the operation in the single-color image forming mode, at the station which is used, the state between the drum 1 and the belt 9 are changed to the contact state. When the operation in the single-color image forming mode is ended, at the station which is used, the state between the drum 1 and the belt 9 is returned to the separation state, so that the station is in the stand-by state.

The cleaning control of the roller 14 in the operation in the above-described single-color image forming mode is summarized as follows. In the operation in the single-color image forming mode, the control circuit portion B executes the cleaning of the roller 14 by effecting the following control during a predetermined ending operation of the image forming apparatus performed after the completion of the image forming operation for the set predetermined print job.

The control circuit portion B controls the shift mechanism 16 so that the state between the belt 9 and at least one drum (second image bearing member) other than the drum (first image bearing member) used in the operation in the single-color image forming mode is changed from the separation state to the contact state. The associated drum (image bearing member) 1 is controlled so as to be in a rotation state. A bias for moving (discharging) the toner detected on the roller 14 onto the belt 9 is applied from the charge voltage output means 19 to the roller 14. Then, the control circuit portion B effects control for applying, from the transfer voltage output means 15 to the associated drum 1, a bias for reversely transferring the moved toner from the belt 9 onto the drum 1 at the control portion N1 between the drum 1 and the belt 9.

As a result, in the operation in the single-color image forming mode, the collection of the toner moved from the roller 14 to the belt 9 is also effected at the station other than the station used in the operation in the single-color image forming mode, so that it is possible to prevent the occurrence of the overflow of the residual toner at the station used in the operation in the single-color image forming mode. Incidentally, in this embodiment, the drum 1*d* on which the toner image is formed by the operation in the single-color image forming mode is the first image bearing member, and the drums 1*b* and 1*c* on which the toner images are formed by the operation in the full-color mode and on which the toner is collected from the belt 9 in the operation in the single-color image forming mode are the second image bearing member.

Embodiment 2

Figure 3:
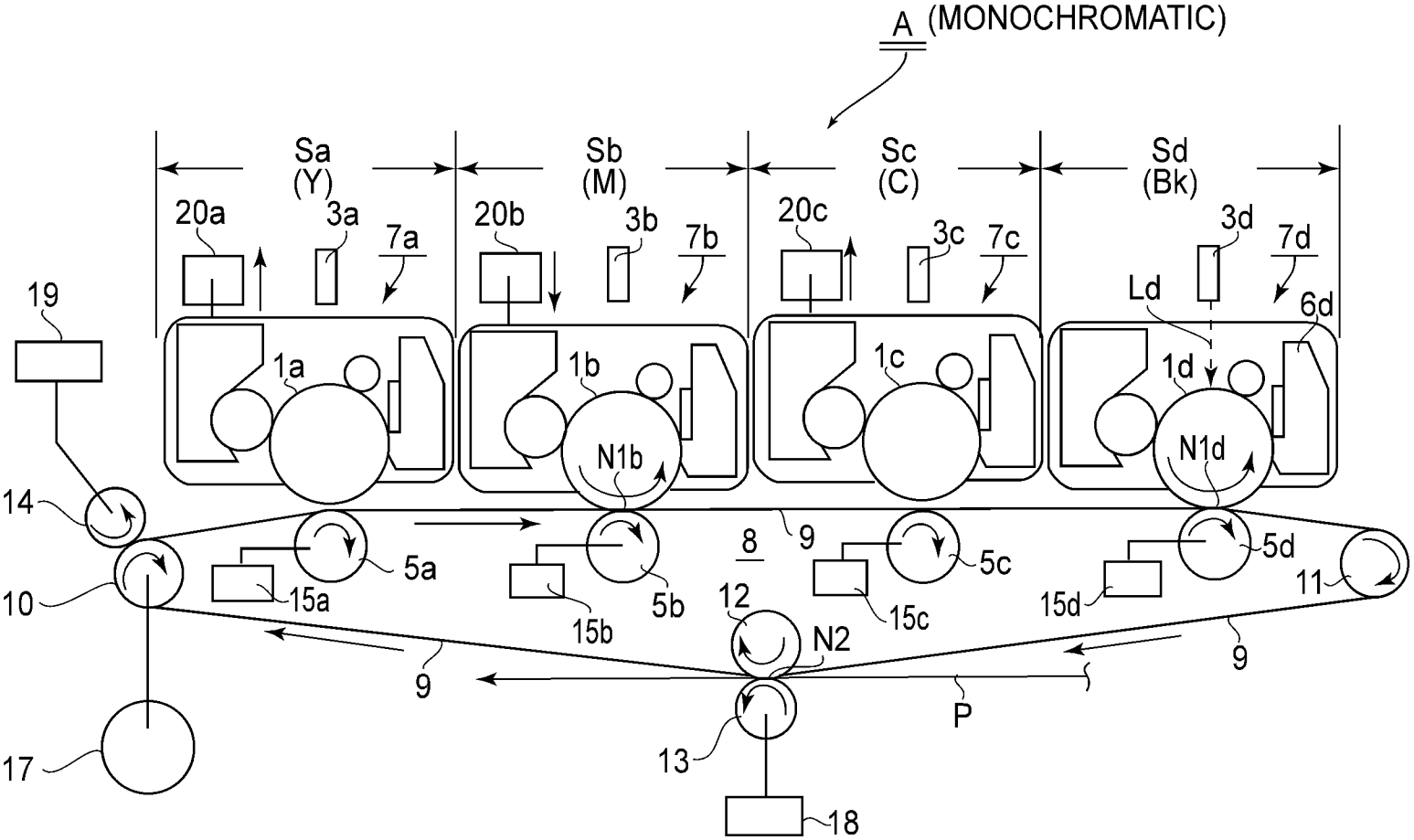
FIG. 3 is an illustration of an image forming apparatus of an intermediary transfer in-line type (monochromatic mode) in Embodiment 2.

FIG. 3 is a schematic illustration of a principal part of an image forming apparatus A in this embodiment. Constituent members or portions common to the apparatuses A in Embodiments 1 and 2 are represented by the same reference numerals or symbols and will be omitted from redundant description. In the apparatus A in this embodiment, the contact and separation between the belt 9 and the drums 1*a*, 1*b* and 1*c* of the first to third stations Sa, Sb and Sc are effected by vertically moving the cartridges 7*a*, 7*b* and 7*c* relative to the belt 9. In this embodiment, a shift mechanism 20 (state changing means) controlled by the control circuit portion B is provided.

That is, each of the cartridges 7*a*, 7*b* and 7*c* at the first to third stations Sa, Sb and Sc is constituted so as to be positionally changed (moved) between the raised position and the lowered position by an associated shift mechanism 20*a*, 20*b* or 20*c* controlled by the control circuit portion B. Although a specific example of the shift mechanism 20 is omitted from illustration in order to avoid complicatedness of illustration, e.g., an appropriate mechanism using a lever and a cam or using a solenoid can be used.

A feature of this embodiment is not the collection of the toner moved from the roller 14 but is such that the toner remaining on the belt 9 as the transfer residual toner during the normal image formation is collected at the station other than the station where the image is formed.

In this embodiment, with respect to the cartridge 7*d* at the fourth station Sd, the roller 5*d* is always kept in the state of contact to the lower surface of the belt 9 toward the drum 1*d*. Also with respect to this roller 5*d*, it is possible to employ the constitution in which the drum 1*d* and the belt 9 are positionally changed between the raised position and the lowered position by the shift mechanism 16.

In FIG. 3, with respect to the cartridges 7*a* and 7*c* at the first and third stations Sa and Sc, a state in which the cartridges 7*a* and 7*c* are positionally changed to the raised positions by the shift mechanisms 20*a* and 20*c*, respectively, is shown. With respect to the cartridge 7*b* at the second station Sb, a state in which the cartridge 7*b* is positionally changed to the lowered position by the shift mechanism 20*b* is shown.

In the unit 8, the respective primary transfer rollers 5*a*, 5*b*, 5*c* and 5*d* are provided at predetermined positions. The cartridges 7*a*, 7*b* and 7*c* are positionally changed to the lowered positions, so that the drums 1*a*, 1*b* and 1*c* are contacted to the belt 9 toward the primary transfer rollers 5*a*, 5*b* and 5*c* to be placed in the state in which the primary transfer portions N1*a*, N1*b* and N1*c* are formed. Further, the cartridges 7*a*, 7*b* and 7*c* are positionally changed to the raised positions, so that the cartridges are placed in the separation state in which the drums 1*a*, 1*b* and 1*c* are separated from the belt 9 (in a state in which the primary transfer portions N1*a*, N1*b* and N1*c* are eliminated).

As for the cartridge 7*d* at the fourth station Sd, in this embodiment, the drum 1*d* is always kept in the state of contact to the belt 9 toward the primary transfer roller 5*d*, thus being kept in a state in which the primary transfer portion N1*d* is always formed.

1) During the operation in the full-color mode, the cartridges 7*a*, 7*b* and 7*c* at the first to third stations Sa, Sb and Sc are all positionally changed to the lowered positions. As a result, at all the first to fourth stations Sa, Sb, Sc and Sd, the primary transfer portions N1*a*, Nab, N1*c* and N1*d* are formed. In this state, the operation in the full-color mode is executed by the same apparatus operation as that in the full-color mode of the apparatus A in Embodiment 1.

Further, the cleaning of the belt 9 and the cleaning of the roller 14 during the operation in the full-color mode are also executed by the same apparatus operation as those during the operation in the full-color mode of the apparatus A in Embodiment 1.

2) Although the operation in the monochromatic mode and the cleaning of the belt 9 and the cleaning of the roller 14 in the operation in the monochromatic mode can also be executed by the same apparatus operation as those during the operation in the monochromatic mode of the apparatus A in Embodiment 1, in this embodiment, the above operation and cleaning operations are performed by the following apparatus operation.

During the operation in the monochromatic mode, the control circuit portion B positionally changes, to the lowered position, at least one of the cartridges 7*a*, 7*b* and 7*c* at the first to third stations Sa, Sb and Sc other than the fourth station Sd for Bk. As a result, the drum 1 of the associated cartridge 7 is contacted to the belt 9 to create the state in which the primary transfer portion N1 is formed. Further, the control circuit portion B places the drum 1 of the cartridge 7, positionally changed to the lowered position, in the rotation state. However, the image forming operation by this cartridge is prevented.

FIG. 3 shows a state in which the cartridge 7*b* at the second station Sb is positionally changed to the lowered position, so that the drum 1*b* is contacted to the belt 9 to form the primary transfer portion Nib. In this state, the control circuit portion B executes the operation in the monochromatic mode by performing the image forming operation at the fourth station for Bk. The residual toner remaining on the drum 1*d* without being transferred on the belt 9 in the primary transfer step of the Bk toner image from the drum 1*d* onto the belt 9 at the primary transfer portion N1*d* is removed and collected by the cleaning device 6*d*.

Further, during the image forming operation in the monochromatic mode, the bias voltage of the positive polarity opposite to the negative polarity as the normal toner charge polarity is applied from the charge voltage output means 19 to the roller 14. In this embodiment, as the positive bias voltage, an oscillating voltage is in the form of a DC voltage biased with a rectangular waveform of 1000 Hz in frequency and 2000 V in peak-to-peak voltage. As a result, the positive electric charge is imparted to the residual toner remaining on the belt 9 without being secondary-transferred.

Further, with respect to the primary transfer roller 5*b* at the second station Sb where the drum 1*b* is contacted to the belt 9 to form the primary transfer portion N1*b*, the toner is attracted from the drum 1*b* to the belt 7. For that purpose, to the primary transfer roller 5*b*, the bias voltage of the positive polarity opposite to the negative polarity as the normal charge polarity of the toner is applied. Therefore, the residual toner on the belt 9 is reversely transferred from the belt 9 onto the drum 1*b* at the primary transfer portion N1*b* of the second station Sb located upstream of the fourth station Sd for Bk, so that substantially all of the residual toner is collected at the second station Sb.

As a result, the residual toner collected from the cartridge 7*d* at the fourth station Sd can be prevented from overflowing.

Thus, in the operation in the single-color image forming mode, the shift mechanism 20 is controlled so that at least one of the drums (the drum 1*b* as the second image bearing member in this embodiment) other than the drum 1*d* (first image bearing member) used for the formation of the toner image is placed in the state of contact to the belt 9. Then, the residual toner on the belt 9 is collected onto the drum 1*b*. On the other hand, in the operation in the single-color image forming mode, the shift mechanism 20 is controlled so that the drums 1*a* and 1*b* (third image bearing member) which are not subjected to the toner image formation and the collection of the toner from the belt 9 are placed in the separation state.

Incidentally, with respect to the collection of the residual toner from the belt 9, the drum 1*d* on which the toner image is formed in the operation in the single-color image forming mode is the first image bearing member, and the drum 1*b* on which the toner is collected in the operation in the single-color image forming mode is the second image bearing member. Further, the drums 1*a* and 1*c* placed in the separation state in the operation in the single-color image forming mode are the third image bearing member. In the operation in the single-color image forming mode, there are at least the drums (third image bearing member) separated from the belt 9. For that reason, with respect to the separated drums, the friction with the belt 9 is avoided, so that deterioration of the drums can be prevented.

Further, with respect to the cleaning of the roller 14 in the ending operation after the image forming operation for the set predetermined print job, the control circuit portion B applies the toner movement bias from the toner charge voltage output means 19 to the roller 14 similarly as in Embodiment 1. Further, to the primary transfer roller 5*b* at the second station Sb where the drum 1*b* is contacted to the belt 9 to form the primary transfer portion N1*b*, the bias of the predetermined potential of the same polarity as the normal toner charge polarity is applied from the transfer voltage output means 15*b*.

As a result, the residual toner moved (discharged) onto the belt 9 is reversely transferred from the belt 9 onto the drum 1*b* at the primary transfer portion N1*b* of the second station Sb located upstream of the fourth station Sd for Bk, so that almost all the residual toner is collected at the second station Sb. As a result, the residual toner collected from the cartridge 7*d* of the fourth station Sd can be prevented from overflowing.

Figure 9:
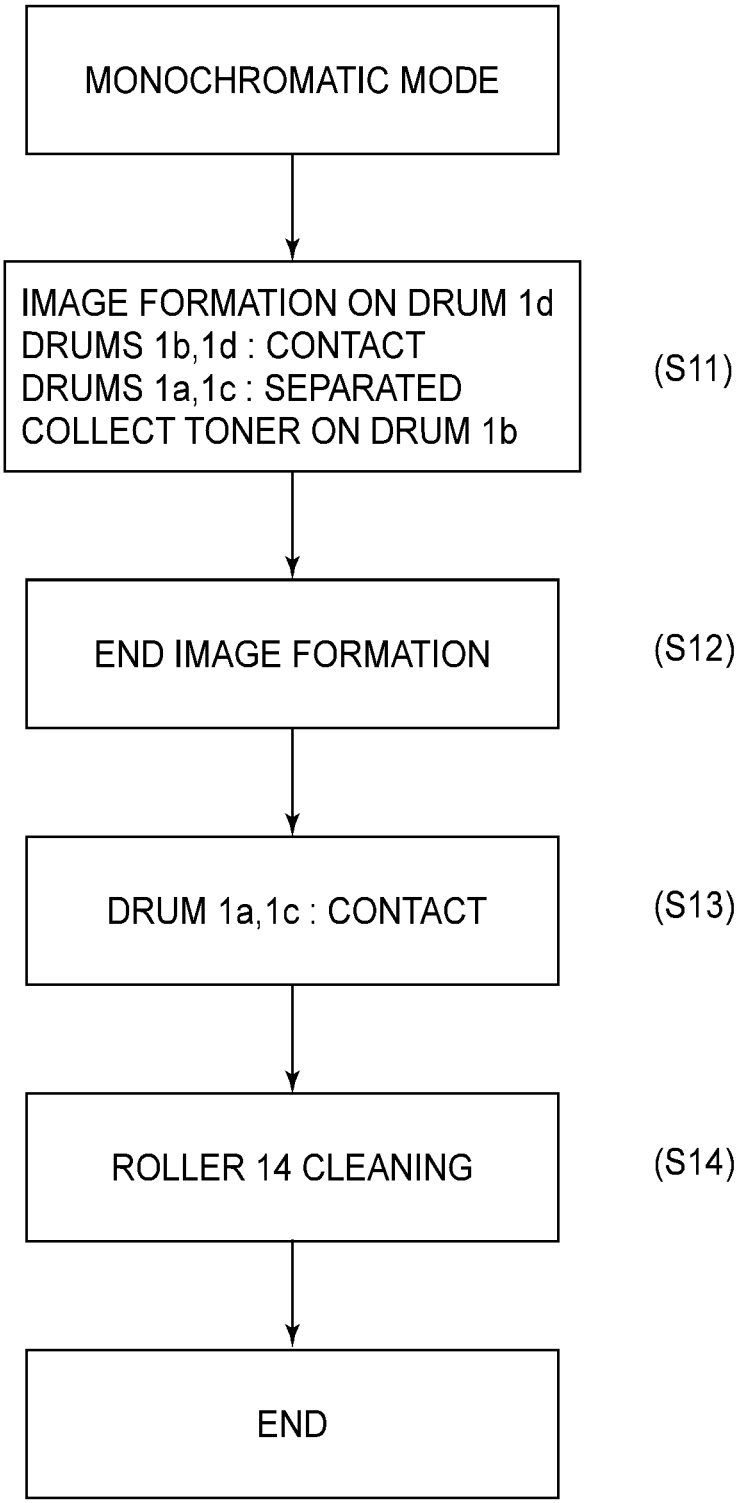
FIG. 9 is a flow chart of image formation in Embodiment 2.

An image formation flow in this embodiment will be described with reference to FIG. 9.

When the monochromatic mode is selected, the drum 1*d* on which the toner image is to be formed is placed in the state of contact to the belt 9. Further, the drum 1*b* on which the residual toner is to be collected is also placed in the state of contact to the belt 9. Other drums 1*a* and 1*c* are placed in the state of separation from the belt 9. In these states, image formation is effected (S11). When the image forming operation is ended (S12), the belt 9 is contacted to the drums 1*a* and 1*c* for performing a cleaning operation of the roller 14 (S13). Then, the toner is moved from the roller 14 onto the belt 9 and is collected by the drums 1*b* and 1*c* to clean the roller 14 (S14).

In this embodiment, the example in which the drum 1*b* at the second station Sb is placed in the state of contact to the belt 9 and then the collection of the secondary transfer residual toner from the belt 9 and the collection of the moved toner from the roller 14 are effected is shown but the present invention is not limited thereto.

The drum 1*a* or 1*c* at the first station Sa or the third station Sc may also be placed in the state of contact to the belt 9. Further, two of the first to third stations Sa, Sb and Sc may also be used in combination in the contact state.

Further, the drums 1*a*, 1*b* and 1*c* at the first to third stations Sa, Sb and Sc may also be subjected to control such that these drums are contacted to the belt 9 in this order or alternately every operation in the monochromatic mode (single-color image forming mode).

The cleaning control of the roller 14 in the operation in the above-described single-color image forming mode is summarized as follows. In the operation in the single-color image forming mode, the control circuit portion B executes the cleaning of the roller 14 by effecting the following control when the image forming operation in performed.

The control circuit portion B controls the shift mechanism 20 so that the state between the belt 9 and the drum 1 of at least one of the stations other than the station (image forming portion in the contact state) used in the operation in the single-color image forming mode is changed from the separation state to the contact state. The associated drum (image bearing member) 1 is controlled so as to be in a rotation state. A bias for moving (discharging) the toner detected on the roller 14 onto the belt 9 is applied from the charge voltage output means 19 to the roller 14. Then, the control circuit portion B effects control for applying, from the transfer voltage output means 15 to the associated drum 1, a bias for reversely transferring the moved toner from the belt 9 onto the drum 1 at the control portion N1 between the drum 1 and the belt 9.

As a result, in the operation in the single-color image forming mode, the collection of the toner moved from the roller 14 to the belt 9 is also effected at the station other than the station used in the operation in the single-color image forming mode, so that it is possible to prevent the occurrence of the overflow of the residual toner at the station used in the operation in the single-color image forming mode.

Embodiment 3

Figure 4:
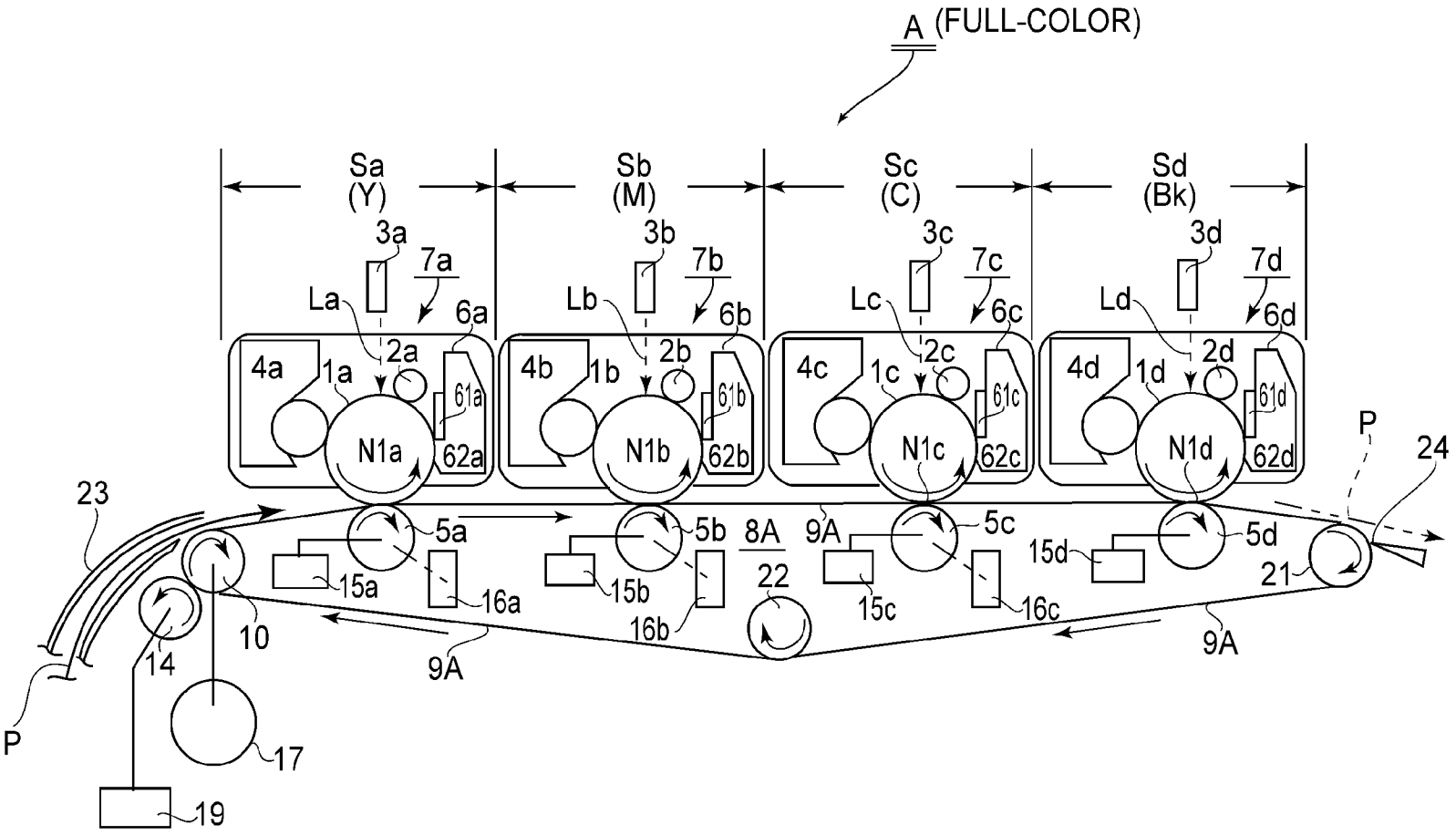
FIG. 4 is an illustration of an image forming apparatus of a direct transfer in-line type (full-color mode) in Embodiment 3.

FIG. 4 is a schematic illustration of a principal part of an image forming apparatus A in this embodiment. The apparatus A employs the apparatus constitution of a direct transfer in-line type in place of the intermediary transfer in-line type of the apparatus A in Embodiment 1. Constituent members or portions common to the apparatuses A in Embodiments 1 and 3 are represented by the same reference numerals or symbols and will be omitted from redundant description. The direct transfer in-line type is employed and therefore there is no secondary transfer roller 13 used in Embodiment 1.

The first to fourth stations Sa, Sb, Sc and Sd have the same constitution as those in the apparatus A in Embodiment 1. In the apparatus A in this embodiment shown in FIG. 4, a recording material conveyance unit 8A is used in place of the intermediary transfer unit 8 in the apparatus A in Embodiment 1. The unit 8A includes a flexible endless recording material conveyance belt 9A as a recording material carrying member which is circulated and moved while carrying the recording material P.

The belt 9A is stretched around a driving roller 10, a follower roller 21 and a tension roller 11 22 which are used as a plurality of supporting members (belt stretching members). The roller 10 is provided at the first station Sa side. The roller 21 is provided at the fourth station Sd side. The roller 22 is provided between and below the rollers 10 and 21. An upper belt portion between the rollers 10 and 21 extends at the lower portion of the first to fourth stations Sa, Sb, Sc and Sd.

The belt 9A is rotated in the clockwise direction (recording material carrying member transfer member movement direction) indicated by arrows at the substantially same peripheral speed as that of the drum 1 by driving the roller 10 by the motor 17 controlled by the control circuit portion B. Therefore, with respect to the movement direction of the upper belt portion between the rollers 10 and 21, the first station Sa for yellow (Y) is the upmost station and the fourth station Sd for black (Bk) is the downstreammost station.

The primary transfer roller 5 at each station S is disposed inside the belt 9A. The transfer voltage output means 15 for the rollers 5, the shift mechanism 16 for the rollers 5, the roller 14 as the toner charging means and the charge voltage applying means 19 for the roller 14 have the same constitutions as those in the apparatus A in Embodiment 1.

1) The operation in the full-color mode is executed, as shown in FIG. 4, in a state in which the belt 9A is placed in the contact state to all the drums 1 of the first to fourth stations Sa, Sb, Sc and Sd to form the primary transfer portions N1*a*, N1*b*, N1*c* and N1*d*. A sheet of the recording material P is separated and fed from a sheet feeding mechanism portion (not shown) and is guided by a guide 23, thus being conveyed from the roller 10 side to the upper belt portion of the belt 9A with predetermined control timing. Then, the recording material P is conveyed from the left side to the right side while being carried on the belt 9A.

By this conveyance, the recording material P is successively passed through the primary transfer portions N1*a*, N1*b*, N1*c* and N1*d* of the first to fourth stations Sa, Sb, Sc and Sd, thus being subjected to the transfer of the toner images of Y, M, C and Bk. Thus, an unfixed full-color toner image based on the four colors of Y, M, C and Bk is synthetically formed. Then, the recording material P is separated from the belt 9A at a recording material separation position 24 near the roller 21 and then is introduced into a fixing device (not shown).

At the recording material separation position 24, a leading end of the recording material P which is carried and conveyed on the belt 9A and which passes through the downstreammost fourth station Sd with respect to the movement direction of the belt 9A is separated from the belt 9A. The recording material P is separated by a separating means (not shown) or curvature-separated. The roller 14 is located downstream of the recording material separation position 24 and upstream of the first station Sa which is the upmost image forming portion of the plurality of the image forming portions.

The control for cleaning the belt 9A and the control for cleaning the roller 14 in the operation in the full-color mode are the same as those in the apparatus A in Embodiment 1.

Figure 5:
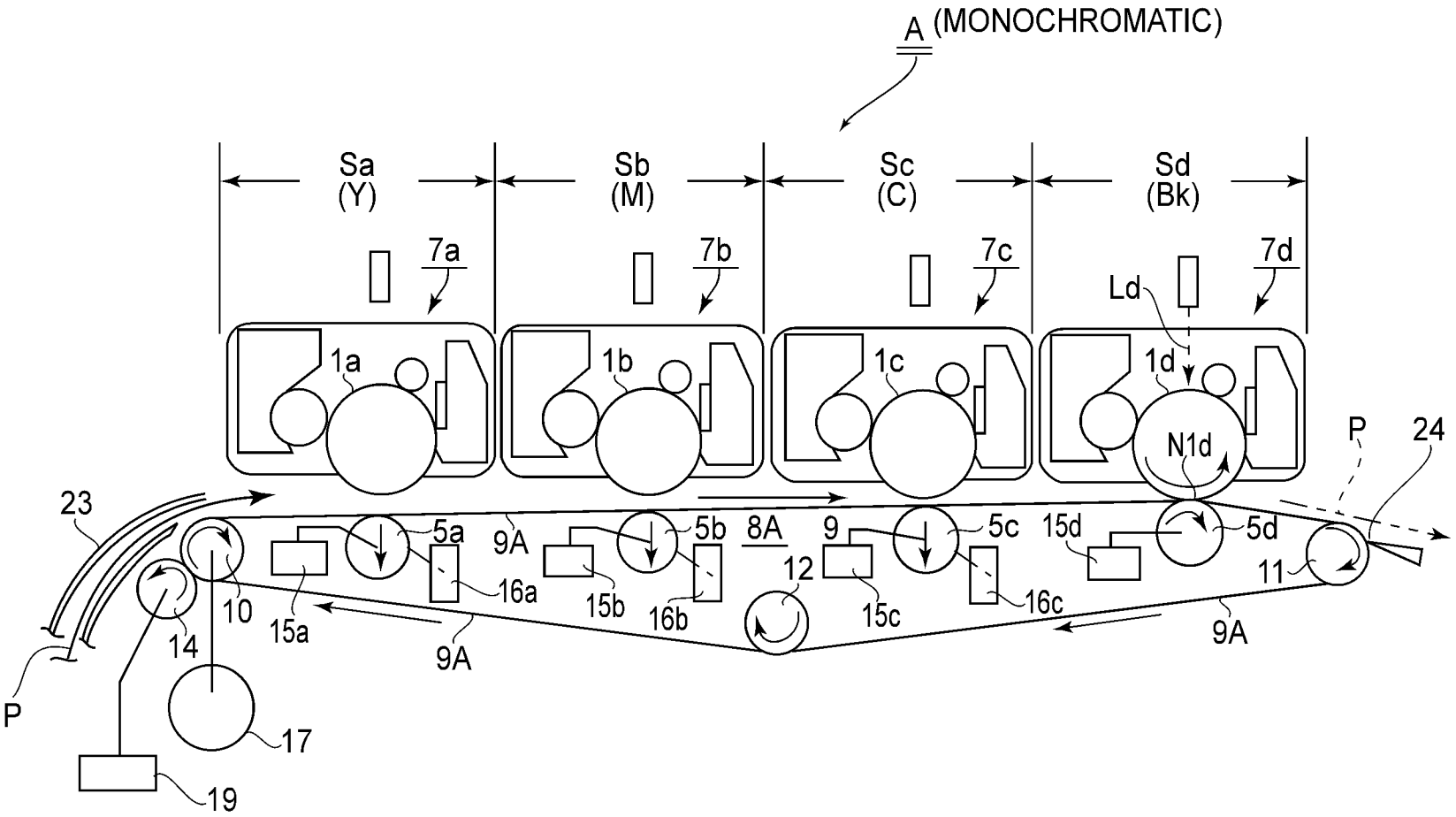
FIG. 5 is an illustration showing a state in which image forming portions and an intermediary transfer member are separated in an operation in a monochromatic mode.

2) During the operation in the monochromatic mode, as shown in FIG. 5, the belt 9 A is separated from the drums 1 of the first to third stations Sa, Sb and Sc to be placed in a state in which the primary transfer portions N1*a*, N1*b* and N1*c* are not formed. To the drum 1*d* of the fourth station Sd, the belt 9 is contacted, so that a state in which the primary transfer portion N1*d* is formed is creased. In this operation in the monochromatic mode, at the first to third stations Sa, Sb and Sc, the rotational drive of the drums 1 is not effected and the image forming operation is kept in a rest (stop) state. Only at the fourth station Sd, the rotational drive of the drum 1*d* is effected and the image forming operation for forming the Bk toner image is executed.

The recording material P is carried and conveyed by the belt 9A to pass through the transfer portion N1*d* of the fourth station Sd, thus being subjected to the transfer of the toner image of Bk. Then, the recording material P is separated from the belt 9A at the recording material separation position 24 and thereafter is introduced into the fixing device (not shown).

In the operation in this monochromatic mode, the control for cleaning the belt 9A and the control for cleaning the roller 14 are the same as those in the apparatus A in Embodiment 1. The control for cleaning the roller 14 is as follows. The control circuit portion B effects the following control during a predetermined ending operation of the image forming apparatus performed after the completion of the image forming operation for the set predetermined print (image forming) job in the same manner as in the apparatus A in Embodiment 1.

The control circuit portion B controls the shift mechanism 16 so that the state between the belt 9A and at least one drum (second image bearing member) other than the drum (first image bearing member) used in the execution of the operation in the monochromatic mode (single-color image forming mode) is changed from the separation state to the contact state. The associated drum 1 is controlled so as to be in a rotation state. A bias for moving (discharging) the toner detected on the roller 14 onto the belt 9 is applied from the charge voltage output means 19 to the roller 14. Then, the control circuit portion B effects control for applying, from the transfer voltage output means 15 to the associated drum 1, a bias for reversely transferring the moved toner from the belt 9A onto the drum 1 at the control portion N1 between the drum 1 and the belt 9A. Incidentally, with respect to the cleaning of the belt 14, in this embodiment, the drum 1*d* on which the toner image is formed by the operation in the single-color image forming mode is the first image bearing member. Further, the drums 1*b* and 1*c* on which the toner images are formed by the operation in the full-color mode and on which the toner is collected from the belt 9 in the operation in the single-color image forming mode are the second image bearing member.

Embodiment 4

Figure 6:
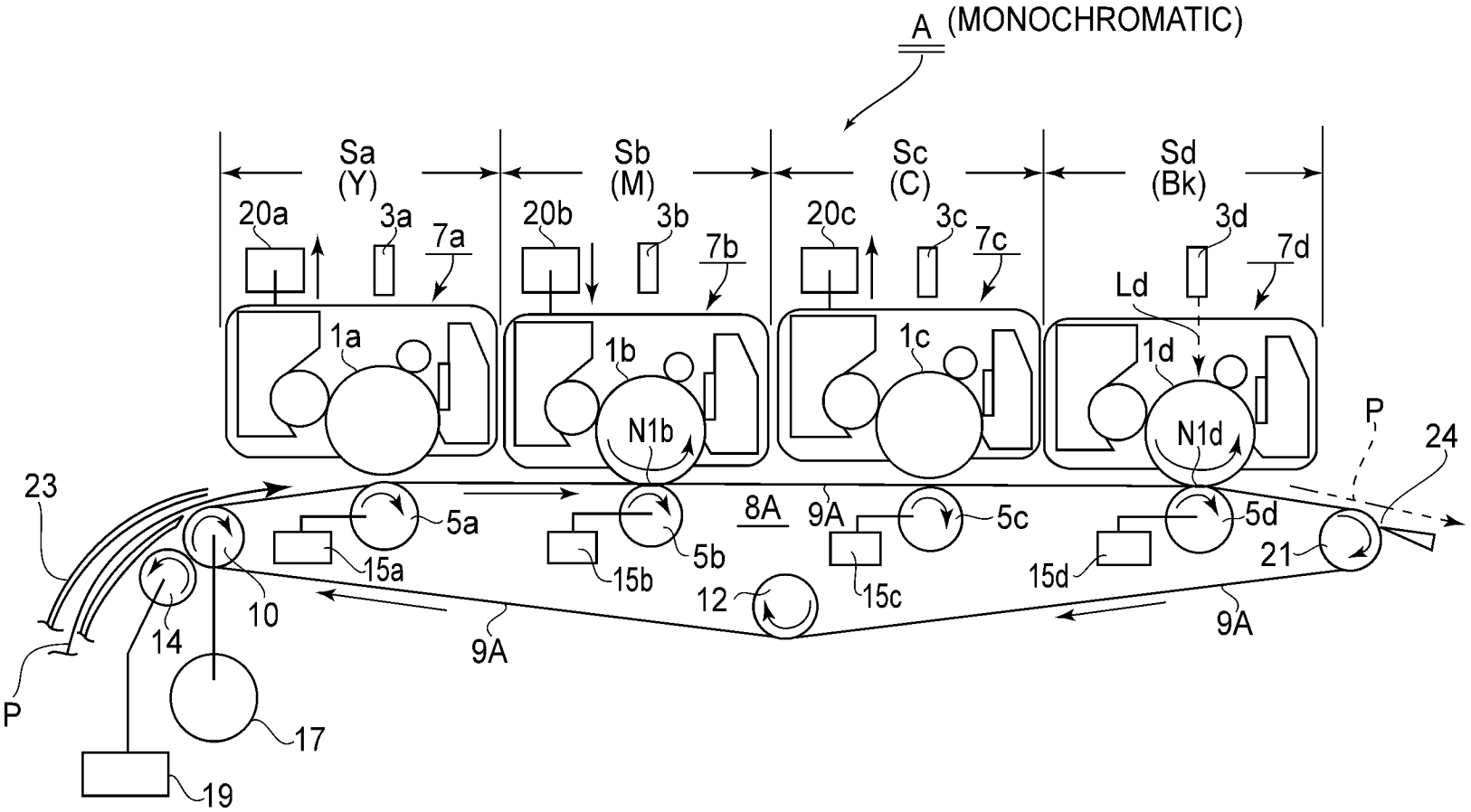
FIG. 6 is an illustration of an image forming apparatus of a direct transfer in-line type (monochromatic mode) in Embodiment 4.

FIG. 6 is a schematic illustration of a principal part of an image forming apparatus A in this embodiment. The apparatus A employs the apparatus constitution of the direct transfer in-line type, similarly as in Embodiment 3, in place of the intermediary transfer in-line type of the apparatus A in Embodiment 2. Constituent members or portions common to the apparatuses A in Embodiments 2, 3 and 4 are represented by the same reference numerals or symbols and will be omitted from redundant description.

A feature of this embodiment is not the collection of the toner moved from the roller 14 but is such that the toner remaining on the belt 9A as the transfer residual toner during the normal image formation is collected at the station other than the station where the image is formed.

1) The operation in the full-color mode is executed, in a state in which the belt 9A is placed in the contact state to all the drums 1 of the first to fourth stations Sa, Sb, Sc and Sd to form the primary transfer portions N1*a*, N1*b*, N1*c* and N1*d*. The control for cleaning the belt 9A and the control for cleaning the roller 14 in the operation in the full-color mode are the same as those in the apparatus A in Embodiment 2.

2) The operation in the monochromatic mode is performed by the same control as in Embodiment 2. FIG. 6 is a schematic illustration corresponding to FIG. 3. In the operation in this monochromatic mode, the control for cleaning the belt 9A and the control for cleaning the roller 14 are the same as those in the apparatus A in Embodiment 2.

The control circuit portion B controls in the operation in the single-color image forming mode, the shift mechanism 16 so that at least one of the drums (the drum 1*b* as the second image bearing member in this embodiment) other than the drum 1*d* (first image bearing member) used for the formation of the toner image is placed in the state of contact to the belt 9A. Then, the residual toner on the belt 9A is collected onto the drum 1*b*. On the other hand, in the operation in the single-color image forming mode, the shift mechanism 20 is controlled so that the drums 1*a* and 1*b* (third image bearing member) which are not subjected to the toner image formation and the collection of the toner from the belt 9A are placed in the separation state.

Incidentally, with respect to the collection of the residual toner from the belt 9A during the image formation, the drum 1*d* on which the toner image is formed in the operation in the single-color image forming mode is the first image bearing member, and the drum 1*b* on which the toner is collected in the operation in the single-color image forming mode is the second image bearing member. Further, the drums 1*a* and 1*c* placed in the separation state in the operation in the single-color image forming mode are the third image bearing member.

As a result, in the operation in the single-color image forming mode, the collection of the toner moved from the roller 14 onto the belt 9A can be effected also at the station other than the station used in the operation in the single-color image forming mode. For that reason, at the station used in the operation in the single-color image forming mode, it is possible to prevent the occurrence of the overflow of the residual toner. Further, in the operation in the single-color image forming mode, there are at least the drums (third image bearing member) separated from the belt 9A. For that reason, with respect to the separated drums, the friction with the belt 9A is avoided, so that deterioration of the drums can be prevented.

In the operation in the single-color image forming mode, the control circuit portion B executes the cleaning of the roller 14 by effecting the following control after the image forming operation in ended.

The control circuit portion B controls the shift mechanism 20 so that the state between the belt 9A and the drum 1 of at least one of the image forming portions (first to third stations Sa, Sb and Sc) other than the image forming portion (fourth station Sd) used in the execution of the operation in the single-color image forming mode is changed from the separation state to the contact state. The associated drum 1 is controlled so as to be in a rotation state. A bias for moving (discharging) the toner detected on the roller 14 onto the belt 9A is applied from the charge voltage output means 19 to the roller 14. Then, the control circuit portion B effects control for applying, from the transfer voltage output means 15 to the associated drum 1, a bias for reversely transferring the moved toner from the belt 9A onto the drum 1 at the control portion N1 between the drum 1 and the belt 9A.

Other Embodiments (1) Each image forming portion is not limited to the image forming mechanism of the electrophotographic type in the embodiments described above. Each image forming portion may also be an image forming mechanism of an electrostatic recording type using an electrostatic recording dielectric member as the image bearing member and an image forming mechanism of a magnetic recording type using a magnetic recording magnetic member as the image bearing member.

(2) The intermediary transfer member or the recording material carrying member is not limited to the endless belt member used in the embodiments described above. The member may also be a drum member.

(3) The plurality of the image forming portions are not limited to the four image forming portions as in the above-described embodiments. Two, three or five or more image forming portions may also be used. The color of the toner may also be transparent or white.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 099317/2011 filed Apr. 27, 2011 and 089377/2012 filed Apr. 10, 2012, which are hereby incorporated by reference.

What is claimed is:

1. An image forming apparatus comprising:

a first image bearing member for bearing a toner image;

a second image bearing member for bearing a toner image;

an intermediary transfer member onto which the toner images formed on said first and second image bearing members are capable of being primary-transferred, wherein said first and second image bearing members are provided along a movement direction of said intermediary transfer member;

a secondary transfer member for transferring the toner images from said intermediary transfer member onto a recording material;

a toner charging member, provided downstream of said secondary transfer member and upstream of the upstreammost image bearing member with respect to the movement direction of said intermediary transfer member, capable of electrically charging a toner transferred on said intermediary transfer member; and a controller for controlling an operation in a single-color image forming mode in which the toner image formed on said first image bearing member is transferred onto said intermediary transfer member to effect image formation in a state of contact between said first image bearing member and said intermediary transfer member and in a state of separation between said second image bearing member and said intermediary transfer member and for controlling an operation in a multi-color image forming mode in which the toner images formed on said first and second image bearing members are transferred onto said intermediary transfer member to effect image formation in a state of contact between said first image bearing member and said intermediary transfer member and in a state of contact between said second image bearing member and said intermediary transfer member, wherein said controller effects, in a post-processing operation after the image formation in the operation in the single-color image forming mode is ended, control such that the state of separation between said second image bearing member and said intermediary transfer member is switched to the state of contact between said second image bearing member and said intermediary transfer member and the toner deposited on said toner charging member is collected onto said second image bearing member via said intermediary transfer member and then is collected by a cleaning device provided for said second image bearing member.

2. An apparatus according to claim 1, wherein said first image bearing member is the downstreammost image bearing member with respect to the movement direction of said intermediary transfer member.

3. An image forming apparatus comprising:

a first image bearing member for bearing a toner image;

a second image bearing member for bearing a toner image;

a recording material carrying member for carrying and conveying a recording material onto which the toner images formed on said first and second image bearing members are capable of being primary-transferred, wherein said first and second image bearing members are provided along a movement direction of said recording material carrying member;

a toner charging member for imparting, at a position located downstream of a recording material separation position where a leading end of a recording material passing through the downstreammost image bearing member is to be separated from said recording material carrying member and upstream of the upstreammost image bearing member with respect to the movement direction of said recording material carrying member, an electric charge to a toner deposited on said recording material carrying member; and a controller for controlling an operation in a single-color image forming mode in which the toner image formed on said first image bearing member is transferred onto the recording material conveyed by said recording material carrying member to effect image formation in a state of contact between said first image bearing member and said recording material carrying member and in a state of separation between said second image bearing member and said recording material carrying member and for controlling an operation in a multi-color image forming mode in which the toner images formed on said first and second image bearing members are transferred onto the recording material conveyed to said recording material carrying member to effect image formation in a state of contact between said first image bearing member and said recording material carrying member and in a state of contact between said second image bearing member and said recording material carrying member, wherein said controller effects, in a post-processing operation after the image formation in the operation in the single-color image forming mode is ended, control such that the state of separation between said second image bearing member and said recording material carrying member is switched to the state of contact between said second image bearing member and said recording material carrying member and the toner deposited on said toner charging member is collected onto said second image bearing member via said recording material carrying member and then is collected by a cleaning device provided for said second image bearing member.

4. An apparatus according to claim 3, wherein said first image bearing member is the downstreammost image bearing member with respect to the movement direction of said recording material carrying member.

* * * * *